US007682050B2

(12) United States Patent
Xiang et al.

(10) Patent No.: US 7,682,050 B2
(45) Date of Patent: Mar. 23, 2010

(54) LED LAMP

(75) Inventors: Qian Xiang, Shenzhen (CN); Guang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/255,657

(22) Filed: Oct. 21, 2008

(65) Prior Publication Data

US 2009/0310349 A1 Dec. 17, 2009

(30) Foreign Application Priority Data

Jun. 13, 2008 (CN) ..... 2008 1 0067734

(51) Int. Cl.
*F21V 29/00* (2006.01)

(52) U.S. Cl. ..... 362/294; 362/249.01; 362/249.02

(58) Field of Classification Search ..... 362/218, 362/240, 294, 345, 351, 356, 373, 410, 545, 362/547, 800; 257/79, 98, 99, 722; 165/104.33; 361/679.52, 679.54, 703, 704, 709, 714
See application file for complete search history.

(56) References Cited

U.S. PATENT DOCUMENTS

2007/0253202 A1* 11/2007 Wu et al. ..... 362/294
2009/0097241 A1* 4/2009 Xu et al. ..... 362/234
2009/0103294 A1* 4/2009 Zhang et al. ..... 362/234

* cited by examiner

*Primary Examiner*—Hargobind S Sawhney
(74) *Attorney, Agent, or Firm*—Frank R. Niranjan

(57) ABSTRACT

An LED lamp includes a base, a heat sink mounted on the base, a plurality of LED modules attached to a circumference of the heat sink, a plurality of reflecting rings enclosing the heat sink and surrounding the LED modules and a heat dissipating member mounted on a top of the heat sink and making thermally conductive contact with the heat sink.

19 Claims, 4 Drawing Sheets

LED LAMP

BACKGROUND OF THE INVENTION

1. Field of the Invention

The disclosure relates to an LED lamp, and more particularly to an improved LED lamp providing even light.

2. Description of Related Art

An LED lamp utilizes light-emitting diodes (LEDs) as a source of illumination, in which current flowing in one direction through a junction region comprising two different semiconductors results in electrons and holes coupling at the junction region and generating a light beam. The LED is resistant to shock and has an almost endless lifetime under specific conditions, making it a popular cost-effective and high quality replacement for incandescent and fluorescent lamps.

Known implementations of LED modules in an LED lamp make use of a plurality of individual LEDs to generate light that is ample and of satisfactory spatial distribution. The large number of LEDs, however, increases price and power consumption of the module. Considerable heat is also generated, which, if not adequately addressed at additional expense, impacts LED lamp reliability.

Further, since the LEDs are generally arranged on a printed circuit board having a flattened surface, illumination is distributed at a wide variety of spatial angles with sharp differences in intensity and brightness, making it unsuitable for environments requiring even and broad illumination.

What is needed, therefore, is an LED lamp which can overcome the limitations described.

SUMMARY OF THE INVENTION

An LED lamp includes a base, a heat sink mounted on the base, a plurality of LED modules attached to a circumference of the heat sink, a plurality of reflecting rings mounted over the base and surrounding the heat sink and the LED modules and a heat dissipating member mounted on a top of and making thermally conductive contact with the heat sink.

Other advantages and novel features will become more apparent from the following detailed description of preferred embodiments when taken in conjunction with the accompanying drawings.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
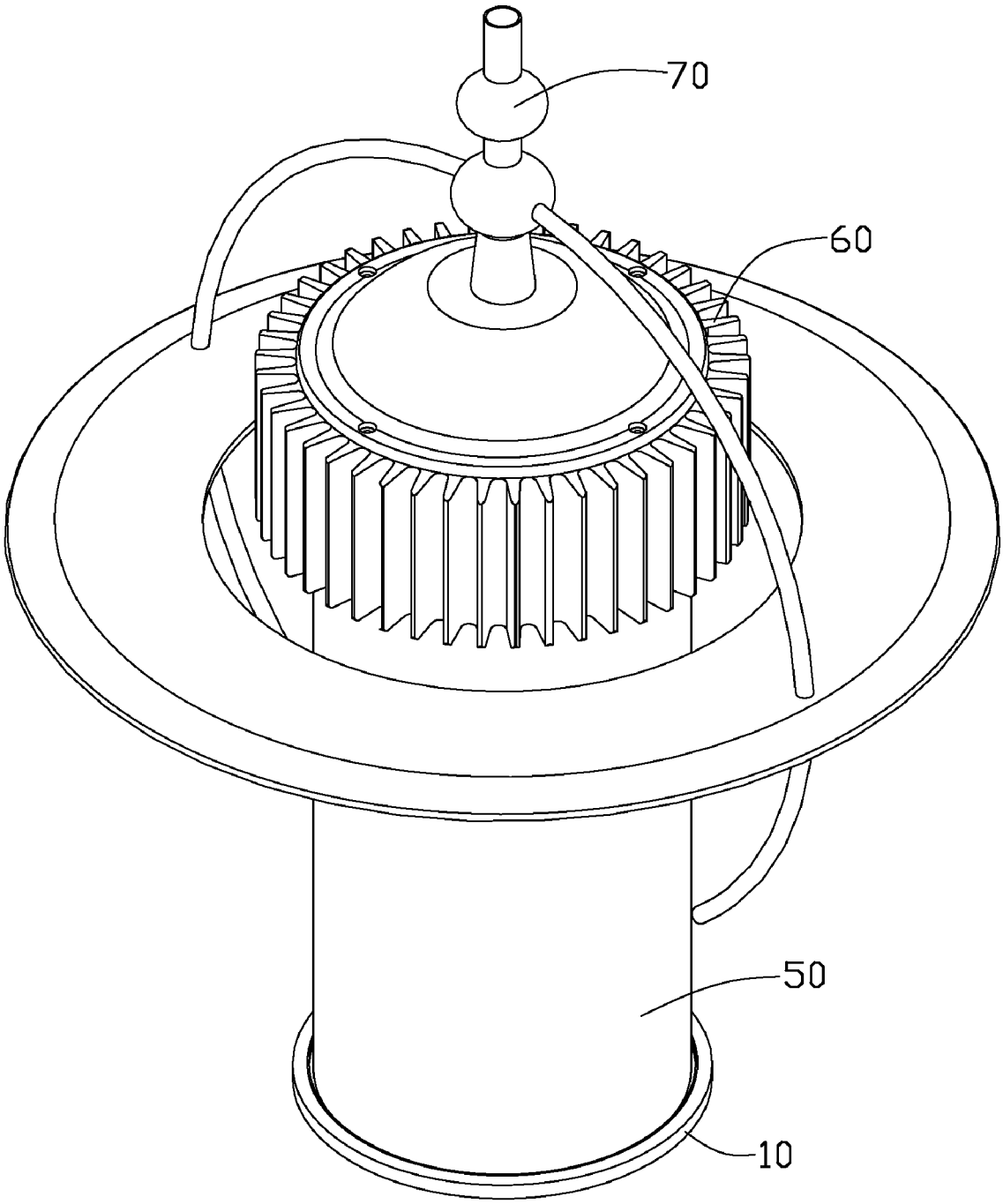
FIG. 1 is an isometric, assembled view of an LED lamp in accordance with a preferred embodiment of the disclosure.
Figure 2:
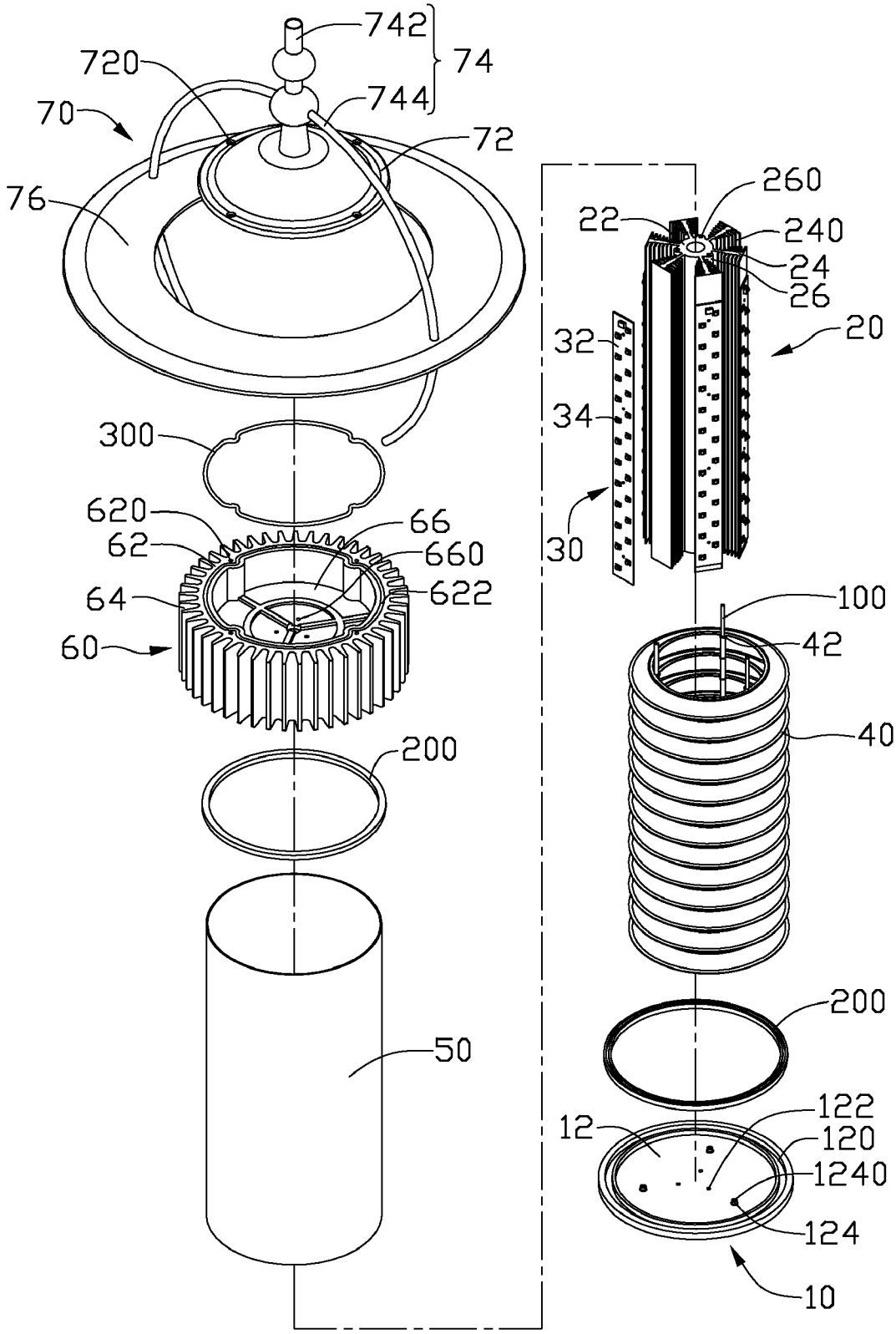
FIG. 2 is an exploded view of FIG. 1.
Figure 3:
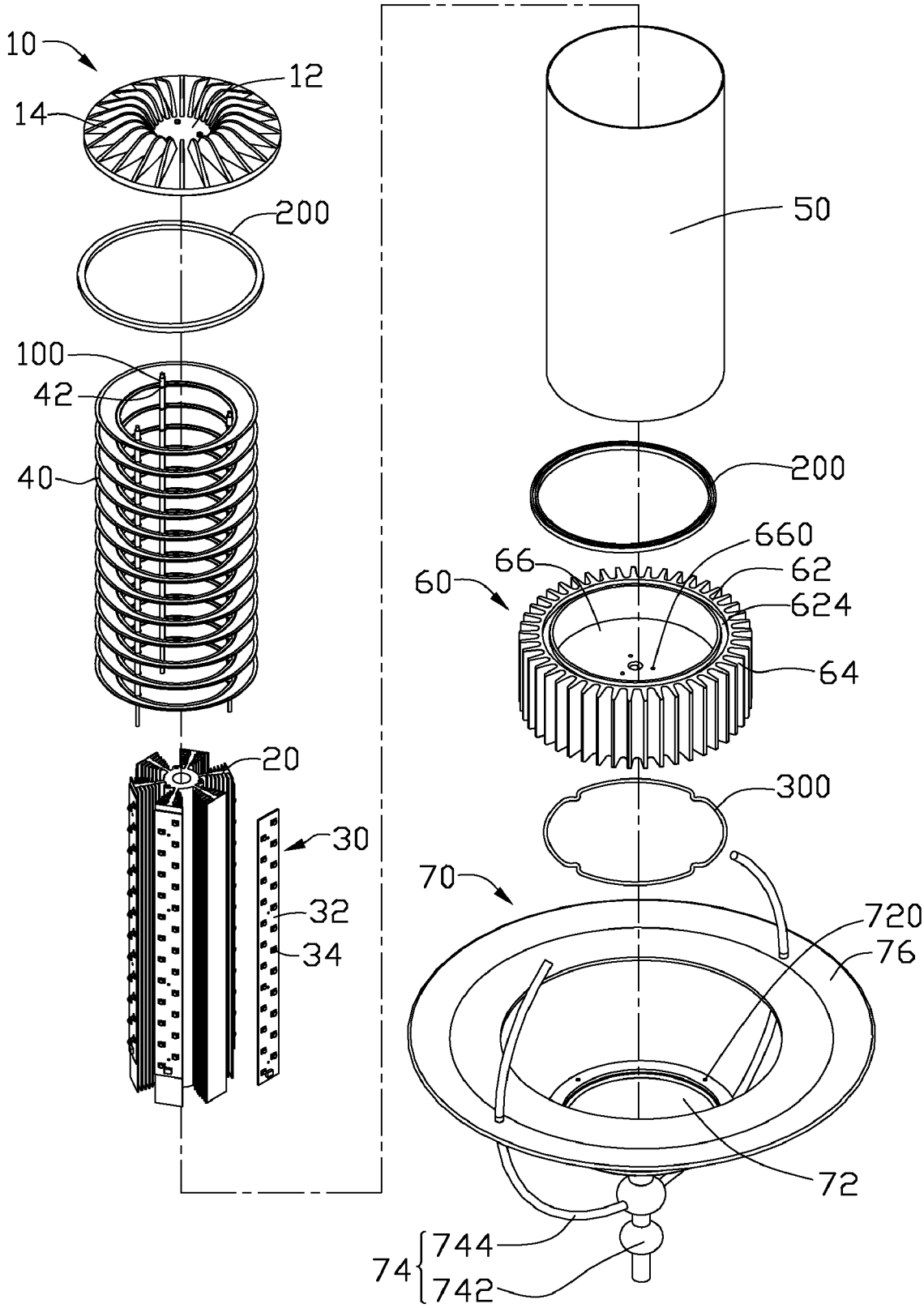
FIG. 3 is an inverted view of FIG. 2.

Referring to FIGS. 1-3, an LED lamp in accordance with a preferred embodiment is illustrated. The LED lamp comprises a base 10, a heat sink 20 mounted on the base 10, a plurality of LED modules 30 attached to a circumference of the heat sink 20, a plurality of reflecting rings 40 encircling the LED modules 30 and the heat sink 20, an envelope 50 vertically mounted on the base 10 and enclosing the LED modules 30 and the heat sink 20, a heat dissipating member 60 mounted on a top of the heat sink 20 and engaging a top end of the envelope 50, and a fixing member 70 fixed on a top of the heat dissipating member 60.

The base 10 is integrally formed of a metallic material with high heat conductivity. The base 10 comprises a circular base plate 12 and a plurality of vanes 14 extending downwardly from a bottom surface thereof. The base plate 12 has an annular step (not labeled) protruding upwardly and perpendicularly from a rim thereof. An annular receiving groove 120 adjacent to the rim of the base plate 12 is defined in the annular step, engagingly receiving a lower end of the envelope 50. The base plate 12 evenly defines three through holes 122 in a central portion thereof. The three through holes 122 are symmetrical relative to a center of the base plate 12 and configured for allowing screws to extend therethrough to engage with a bottom of the heat sink 20. The base plate 12 has three fixing lugs 124 projecting upwardly from the top surface thereof. The three fixing lugs 124 surrounding the through holes 122 are also symmetrical relative to the center of the base plate 12 and each define a fixing orifice 1240 therein. The vanes 14 are radially arranged on the bottom surface of base plate 12 and perpendicular to the base plate 12.

The heat sink 20 is integrally formed of a material with good heat conductivity such as aluminum or copper. In the preferred embodiment, the heat sink 20 is formed by aluminum extrusion. The heat sink 20 has an elongated cylinder 22 at a center thereof and a plurality of conducting arms 24 extending outwardly from a circumference of the cylinder 22. The conducting arms 24 are identical and symmetrical relative to the central axis of the cylinder 22, and correspond in number to the LED modules 30 which can differ by embodiment. In this embodiment, the quantity of the conducting arms 24 and the LED modules 30 is both six. A plurality of fins 240 are formed on two opposite lateral sides of the conducting arms 24. The fins 240 extend oppositely and perpendicularly from two lateral sides of each of the conducting arms 24 and are symmetrical relative to a corresponding conducting arm 24. The widths of the fins 240 at a lateral side of the corresponding conducting arm 24 gradually increase from the cylinder 22 to a distal end of the corresponding conducting arm 24. Each outermost fin 240 of the conducting arms 24 has an inner face at which the distal end of the conducting arms 24 terminates and a flat outer face of the each outermost fin 240 on which one of the LED modules 30 is mounted. The heat sink 20 has three mounting posts 26 formed on the circumference of the cylinder 22, symmetrical relative to the axis of the cylinder 22. Each of the mounting posts 26 is located between two neighboring conducting arms 24. The mounting posts 26 each have an upper end coplanar with a top surface of the cylinder 22 and a lower end coplanar with a bottom surface of the cylinder 22. Each of the mounting posts 26 defines two mounting holes 260 respectively in the upper and lower ends thereof, engagingly receiving screws (not shown) extending through the heat dissipating member 60 to fix the heat dissipating member 60 on the heat sink 20 and the screws extending through the through holes 122 of the base 10 to couple the base 10 to the underside of the heat sink 20.

The LED modules 30 each comprise an elongated printed circuit board 32 smaller than the outermost fin 240 of the heat sink 20. A plurality of LED components 34 are lined up on each of the printed circuit boards 32 along a length thereof.

Figure 4:
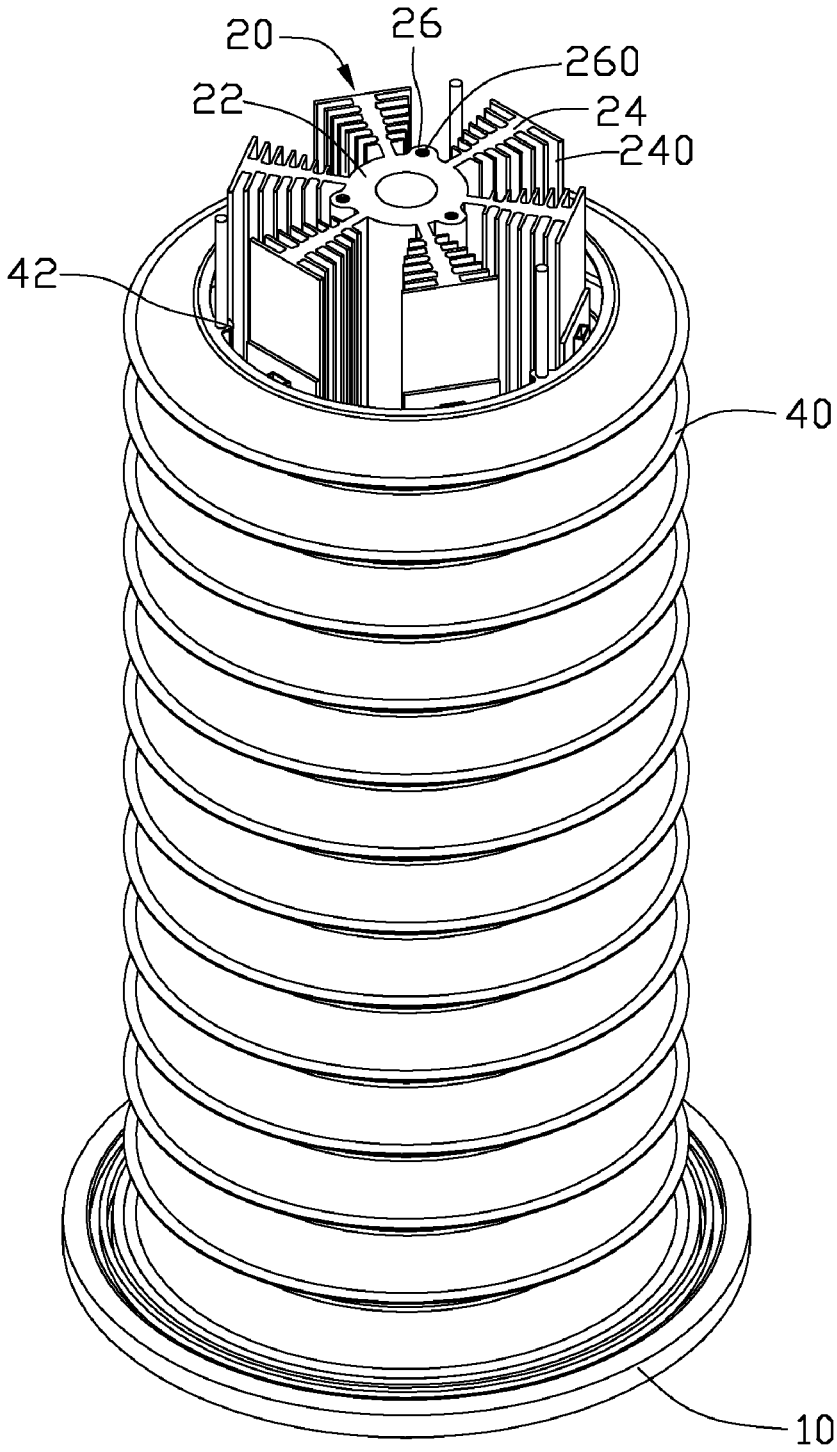
FIG. 4 is a partial assembled view of the LED lamp of FIG. 1 with some elements absent for increased visibility.

Also referring to FIG. 4, the reflecting rings 40 are annular vanes with an inner edge higher than an outer edge thereof, thereby defining an annular inclined surface thereon to evenly reflect light generated by the LED modules 30 to a surrounding environment of the LED lamp. Each of the reflecting rings 40 has three tabs 42 extending inwardly from the inner edge thereof and equally spaced from each other. The reflecting rings 40 encircle the LED modules 30 and the heat sink 20, are parallel, and separated by a predetermined distance. Three retaining shafts 100 extend vertically through the corresponding tabs 42 of the reflecting rings 40 in alignment to fix the reflecting rings 40 in place.

The envelope 50 is transparent/translucent plastic or glass in the form of a canister. The envelope 50 encloses the heat sink 20 to which the LED modules 30 are attached. The envelope 50 has a lower end inserted into the receiving groove 120 of the base 10 and an upper end engaging with the heat dissipating member 60 to secure the envelope 50 to the heat dissipating member 60.

The heat dissipating member 60 is metallic material with high heat conductivity and comprises a conducting canister 62, a plurality of cooling ribs 64 protruding outwardly from a circumference of the conducting canister 62 and a conducting board 66 located inside of the conducting canister 62 and separating an inner space thereof into two equal parts. The conducting canister 62 snugly receives an upper portion of the heat sink 20 and symmetrically defines a plurality of engaging holes 620 in a top end thereof through which screws (not shown) extend to secure the fixing member 70 to the heat dissipating member 60. The conducting canister 62 defines an engaging groove 622 in the top end thereof receiving a washer 300 and an engaging groove 624 in a bottom end thereof receiving a gasket 200. The cooling ribs 64 are symmetrical and parallel. The conducting board 66 is perpendicular to the axis of the conducting canister 62 and defines three extending holes 660 therein through which the screws extend to engage the mounting holes 260 of the top of the heat sink 20. The conducting board 66, on which related electronic components such as a rectifier and control circuit board can be mounted, can transfer heat generated by the electronic components to the cooling ribs 64 for heat dissipation.

The fixing member 70 is configured to suspend the LED lamp and comprises an inverted disk-shaped top cover 72, an annular reflecting plate 76 surrounding the heat dissipating member 60 and a connecting assembly 74 coupling the top cover 72 and the reflecting plate 76 together. The top cover 72 covers the top end of the conducting canister 62 of the heat dissipating member 60 and has a diameter equal to an outer diameter of the conducting canister 62. The top cover 72 symmetrically defines a plurality of mounting holes 720 therein and arranged along and near a rim thereof through which the screws extend into the engaging holes 620 of the top end of the heat dissipating member 60 to securely couple the fixing member 70 thereto. The connecting assembly 74 comprises a suspending post 742 extending upwardly from a center of a top surface of the top cover 72 and a connecting wire 744 connecting the reflecting plate 76 and the suspending post 742 together. The suspending post 742 has two balls expanding outwardly from a circumference thereof, forming a figure-8 in profile, for increasing the aesthetic attraction of the LED lamp. The connecting wire 744 is bent into a curve and extends through a lower ball and two opposite parts of the reflecting plate 76. The reflecting plate 76 is on the same level as the lower end of the heat dissipating member 60 and has an annular inclined bottom surface facing the LED modules 30 for reflecting light generated by the LED modules 30 downwardly.

In the final assembly form of the LED lamp, the heat sink 20 is vertically placed on the base 10 and secured by the screws extending through the through holes 122 of the base 10 and into the mounting holes 260 of the heat sink 20. The LED modules 30 are respectively attached to the outer faces of the outermost fins 240. The reflecting rings 40 are assembled together by the retaining shafts 100 and enclose the heat sink 20. The reflecting rings 40 are held in a position by the lower ends of the retaining shafts 100 being engagingly received in the fixing holes 1240 of the fixing lugs 124 of the base 10. The heat dissipating member 60 is mounted on the top of the heat sink 20 by the screws extending through the extending holes 660 and engaging into the mounting holes 260. The envelope 50 cooperates with the base 10 and the heat dissipating member 60 to seal the heat sink 20 and the LED modules 30, with the upper end thereof engaging the engaging groove 624 of the bottom end of the heat dissipating member 60 and the lower end thereof engaging the receiving groove 120 of the base 10. The top cover 72 of the fixing member 70 is fixed to the top of the heat dissipating member 60 and configured to engage a hanger (not shown) to mount the LED lamp. In additional, the gaskets 200 are respectively received in the receiving groove 120 of the base 10 and the engaging groove 624 of the heat dissipating member 60, thereby sandwiching the gaskets 200 respectively between the lower end of the envelope 50 and the top of the base 10, and the upper end of the envelope 50 and the bottom of the heat dissipating member 60 to enhance air- and water-tightness capabilities of the LED lamp.

In use, as the six LED modules 30 mounted on the circumference of the heat sink 30 are respectively directed to different orientations of the LED lamp, and further in the guide of the reflecting rings 40, light generated by the LED modules 30 is diffused and evenly distributed to a broad area around the LED lamp, meeting specified requirements of illumination. The heat dissipating member 60, making thermally conductive contact with the heat sink 20, not only removes heat from related electronic components but also seriously assists heat sink 20 in dissipation of heat generated by the LED modules 30.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a base;

a heat sink mounted on the base;

a plurality of LED modules attached to a circumference of the heat sink;

a plurality of reflecting rings enclosing the heat sink and surrounding the LED modules;

a heat dissipating member mounted on a top of the heat sink and making thermally conductive contact with the heat sink, wherein the heat dissipating member comprises a conducting canister, a plurality of cooling ribs protruding outwardly from a circumference of the conducting canister and a conducting board located inside of the conducting canister separating the interior thereof into two parts; and a fixing member having a top cover securely covering a top of the conducting canister, an annular reflecting plate surrounding the heat dissipating member and a connecting assembly coupling the top cover and the reflecting plate together.

2. The LED lamp as claimed in claim 1, wherein the cooling ribs are parallel to an axis of the conducting canister and symmetrical relative to the axis of the conducting canister.

3. The LED lamp as claimed in claim 1, wherein the conducting canister receives an upper end of the heat sink in a lower part thereof and the conducting board is coupled to a top of the heat sink.

4. The LED lamp as claimed in claim 1, wherein the reflecting plate is on the same level as the lower end of the heat dissipating member and has an annular inclined bottom surface facing the LED modules to reflect light generated by the LED modules downwardly.

5. The LED lamp as claimed in claim 1, wherein the connecting assembly comprises a suspending post extending upwardly from a top surface of the top cover and a connecting wire extending through the suspending post and the two opposite parts of the reflecting plate.

6. The LED lamp as claimed in claim 5, wherein a plurality of tabs extend inwardly from the inner edge of each of the reflecting rings and are in alignment with the corresponding tabs of the other reflecting rings, respectively.

7. The LED lamp as claimed in claim 6, wherein a plurality of retaining shafts extend through the corresponding tabs in alignment and each of the retaining shafts has two opposite ends respectively engaging a top surface of the base and a bottom end of the heat dissipating member.

8. The LED lamp as claimed in claim 1, wherein the reflecting rings, parallel to the base, are annular vanes, each having an inner edge higher than an outer edge thereof, thereby defining an annular inclined surface thereon to reflect light generated by the LED modules.

9. The LED lamp as claimed in claim 1, wherein the heat sink comprises an elongated cylinder, a plurality of conducting arms extending outwardly from a circumference of the cylinder and a plurality of fins formed on two opposite lateral sides of a corresponding conducting arm.

10. The LED lamp as claimed in claim 9, wherein the conducting arms are identical to each other and symmetrical relative to the central axis of the cylinder, the fins being symmetrical relative to the corresponding conducting arm and having increasing widths along the cylinder to a distal end of the corresponding conducting arm.

11. The LED lamp as claimed in claim 9, wherein each distal end of the corresponding conducting arm terminates at an inner face of an outermost fin and one of the LED modules is mounted on an outer face of the outermost fin.

12. The LED lamp as claimed in claim 1, wherein the base comprises a circular base plate on which the heat sink is placed vertically and a plurality of vanes arranged radially on a bottom surface of the base plate and perpendicular to the base plate.

13. The LED lamp as claimed in claim 1, further comprising an envelope comprising an upper end engaging a bottom end of the dissipating member and a lower end engaging a top surface of the base, the envelope cooperating with the heat dissipating member and the base to seal the heat sink and LED modules therein.

14. An LED lamp, comprising:

a base;

a heat sink mounted on the base;

a plurality of LED modules attached to a circumference of the heat sink;

a plurality of reflecting rings enclosing the heat sink and surrounding the LED modules;

a heat dissipating member mounted on a top of the heat sink and making thermally conductive contact with the heat sink; and a fixing member having a top cover securely covering a top of the heat dissipating member, an annular reflecting plate surrounding the heat dissipating member and a connecting assembly coupling the top cover and the reflecting plate together.

15. The LED lamp as claimed in claim 14, wherein the heat dissipating member comprises a conducting canister on which the top cover is placed, a plurality of cooling ribs protruding outwardly from a circumference of the conducting canister and a conducting board located inside of the conducting canister separating the interior thereof into two parts.

16. The LED lamp as claimed in claim 14 wherein the connecting assembly comprises a suspending post extending upwardly from a top surface of the top cover and a connecting wire extending through the suspending post and the two opposite parts of the reflecting plate.

17. The LED lamp as claimed in claim 14, wherein the reflecting rings, parallel to the base, are annular vanes, each having an inner edge higher than an outer edge thereof, thereby defining an annular inclined surface thereon to reflect light generated by the LED modules.

18. The LED lamp as claimed in claim 17, wherein a plurality of tabs extend inwardly from the inner edge of each of the reflecting rings and are in alignment with the corresponding tabs of the other reflecting rings, respectively 19. The LED lamp as claimed in claim 18, wherein a plurality of retaining shafts extend through the corresponding tabs in alignment and each of the retaining shafts has two opposite ends respectively engaging a top surface of the base and a bottom end of the heat dissipating member.

* * * * *